US009016999B2

(12) United States Patent
Dezer

(10) Patent No.: US 9,016,999 B2
(45) **Date of Patent: *Apr. 28, 2015**

(54) PASSENGER AND VEHICLE ELEVATOR SYSTEM

(71) Applicant: Gil Dezer, Sunny Isles Beach, FL (US)

(72) Inventor: Gil Dezer, Sunny Isles Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/290,677

(22) Filed: May 29, 2014

(65) Prior Publication Data

US 2014/0271062 A1 Sep. 18, 2014

Related U.S. Application Data

(63) Continuation of application No. 13/755,780, filed on Jan. 31, 2013.

(60) Provisional application No. 61/595,225, filed on Feb. 6, 2012.

(51) Int. Cl.

| | |
|---|---|
| ***E04H 6/22*** | (2006.01) |
| ***E04H 6/42*** | (2006.01) |
| ***E04H 6/28*** | (2006.01) |
| ***E04H 6/40*** | (2006.01) |
| *E04H 1/04* | (2006.01) |
| *E04H 1/06* | (2006.01) |

(52) U.S. Cl.

CPC .. *E04H 6/22* (2013.01); *E04H 6/42* (2013.01); *E04H 1/04* (2013.01); *E04H 1/06* (2013.01); *E04H 6/282* (2013.01); *E04H 6/40* (2013.01)

(58) Field of Classification Search

CPC ..... E04H 6/22; E04H 6/42; E04H 6/40; E04H 6/282

USPC ..... 414/232, 231, 227, 234

See application file for complete search history.

(56) References Cited

U.S. PATENT DOCUMENTS

| | | | | |
|---|---|---|---|---|
| 2,120,751 | A | 6/1938 | Jenney | |
| 2,428,856 | A | 10/1947 | Sinclair | |
| 3,055,517 | A | 9/1962 | Kirkland | |
| 3,395,815 | A * | 8/1968 | Johnson | 414/232 |
| 4,264,257 | A | 4/1981 | Saurwein | |
| 4,768,914 | A | 9/1988 | Sing | |
| 5,749,186 | A | 5/1998 | Kaufman et al. | |

(Continued)

FOREIGN PATENT DOCUMENTS

| | | |
|---|---|---|
| DE | 102 33 558 A1 | 10/2003 |
| JP | 05-010045 | 1/1993 |

(Continued)

*Primary Examiner* — Kaitlin Joerger
(74) *Attorney, Agent, or Firm* — Robert M. Schwartz

(57) ABSTRACT

The passenger and vehicle elevator system includes a plurality of elevator cars arrayed substantially equidistantly and equiangularly from a central shaft of the building. Each elevator car includes a housing and at least one door. The housing has a floor, a ceiling, and at least one sidewall. A linearly translating platform is mounted on the floor of each of the housings. The linearly translating platform is adapted for automatically carrying the vehicle and the at least one passenger through the at least one door. Further, the vehicle may be rotated within the housing by driven rotation of the platform or the floor, allowing for selective angular positioning of the vehicle with respect to the housing. The elevator car ascends and descends within a corresponding elevator shaft in a manner similar to that of a conventional elevator.

14 Claims, 5 Drawing Sheets

(56) References Cited

U.S. PATENT DOCUMENTS

| | | | | |
|---|---|---|---|---|
| 8,632,290 | B2 * | 1/2014 | Alan | 414/234 |
| 2003/0138309 | A1 | 7/2003 | Kozak | |
| 2005/0095092 | A1 * | 5/2005 | Segal et al. | 414/263 |
| 2007/0031218 | A1 * | 2/2007 | Haag | 414/227 |
| 2012/0279807 | A1 | 11/2012 | Finschi et al. | |

FOREIGN PATENT DOCUMENTS

| | | | |
|---|---|---|---|
| JP | 05-071236 | | 3/1993 |
| JP | 2001-200650 | | 7/2001 |
| WO | WO 91/12395 | A1 | 8/1991 |
| WO | WO 2004/045932 | A1 | 6/2004 |

* cited by examiner

PASSENGER AND VEHICLE ELEVATOR SYSTEM

CROSS REFERENCE TO RELATED APPLICATION

This application is a continuation of application Ser. No. 13/755,780, filed Jan. 31, 2013, which claims the benefit of U.S. Provisional Patent Application Ser. No. 61/595,225, filed Feb. 6, 2012.

BACKGROUND OF THE INVENTION

1. Field of the Invention

The present invention relates to elevators, and particularly to a passenger and vehicle elevator system for carrying a vehicle and at least one passenger within a multi-story building.

2. Description of the Related Art

The increasing cost of urban land, together with the need to provide affordable high density housing, as well as low-cost commercial or professional office space, presents several problems in the development of building complexes, particularly including motor vehicle parking facilities. Specifically, the need to develop affordable high-density housing, such as apartment or condominium complexes, has presented a problem in providing adequate space for parking personal motor vehicles in close proximity to the apartment or condominium building or buildings without encountering the prohibitive cost of erecting buildings with garage facilities directly above, or more commonly, directly below the building floors or levels that are dedicated to multiple dwelling units.

National and local regulatory requirements with respect to fire ratings of structures with garages directly underneath residential dwelling units is cost prohibitive with respect to providing affordable housing in many urban areas. Further, the irregular shape of land parcels usually available for high-density housing in highly developed urban areas also presents a problem with respect to the placement of adequate parking spaces for personal automobile vehicles, which are closely adjacent the vehicle owner's dwelling unit.

One solution to the above-mentioned problems is the development of multi-story garages for motor vehicles directly adjacent to, or within, the buildings that include the dwelling units to be occupied by the persons normally parking their vehicles in the garage. Multi-story garages are desired in areas where land costs require a maximum utilization of land area for rentable or saleable building space. However, multi-story garages can be inconvenient to use for many building occupants if parking is required on an upper level of the garage and a pathway between an upper level dwelling unit and the garage requires travel between ground level and the upper garage level, as well as travel between ground level and an upper level dwelling or other occupiable unit in the building or buildings adjacent to the garage.

Multi-story garages have been constructed in which connecting bridges or walkways between parking decks and upper floors of buildings adjacent thereto have required stairways interconnecting the walkways or bridges with the parking decks, since the decks and the respective building floors have not been placed at the same elevations. Such arrangements have been unsatisfactory for elderly and disabled persons, as well as when moving large articles and furnishings between the garage and living units on the closest adjacent floors.

Other considerations that must be taken into account in the development of high-density housing with multistory garages adjacent thereto concerns placement of the garage with respect to the dwelling units while maintaining adequate open space therebetween to conform to regulatory requirements and aesthetic desires of the building occupants.

It would obviously be desirable to be able to provide the same access between a building dwelling unit on an upper floor or level and an upper story garage parking space as is provided for persons occupying a ground floor dwelling unit and corresponding ground level parking. Consideration should be given not only to the convenience of walking a substantially level pathway between a dwelling unit and the parking place for the building occupants' personal vehicles, but also with regard to such activities as trash disposal, mail delivery and pickup and the ease of moving personal effects and furniture in and out of a dwelling unit. Further, it would also be desirable to be able to maximize space for both parking and the residential or office spaces in such an arrangement.

Thus, a passenger and vehicle elevator system solving the aforementioned problems is desired.

SUMMARY OF THE INVENTION

The passenger and vehicle elevator system carries a vehicle containing at least one passenger to a desired parking spot within a multi-story building. The passenger and vehicle elevator system includes a plurality of elevator cars arrayed substantially equidistantly from a central shaft of the building. Each elevator car includes a housing and at least one door. The elevator car housing has a floor, a ceiling and at least one sidewall. The elevator car is dimensioned and configured for carrying a vehicle and at least one passenger. Preferably, parking location-related information is read from the vehicle by an external sensor, such as an RFID sensor, bar code reader, or the like.

A linearly translating platform is mounted to the floor of each of the elevator car housings. The linearly translating platform is adapted for automatically carrying the vehicle and the at least one passenger through the at least one door. Further, the vehicle may be rotated within the housing by driven rotation of the platform or rotation of the floor, allowing for selective angular positioning of the vehicle with respect to the housing. The elevator car ascends and descends within a corresponding elevator shaft in a manner similar to that of a conventional elevator.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
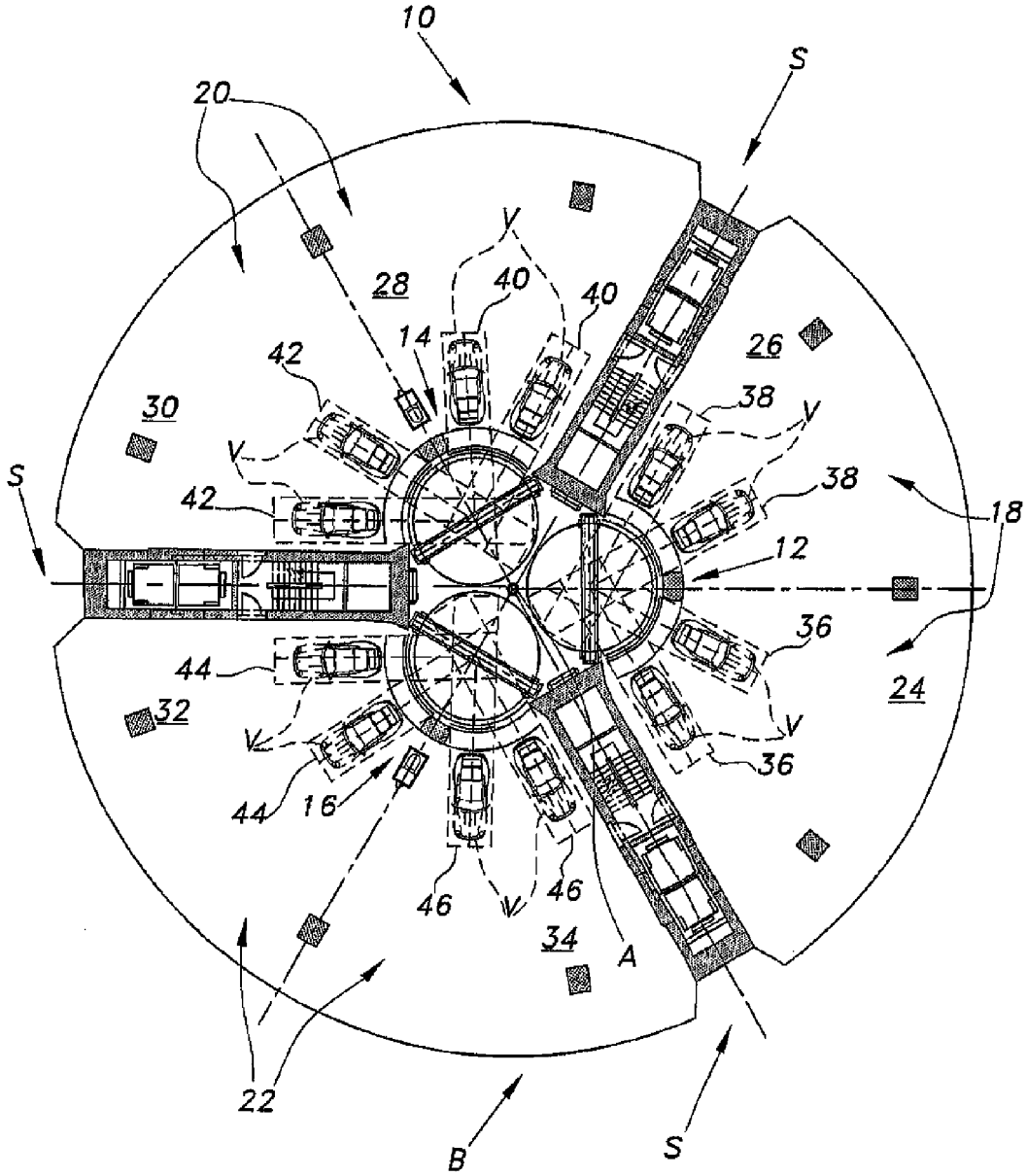
FIG. 1 is a diagrammatic plan view of a single exemplary floor of a multi-story building utilizing a passenger and vehicle elevator system according to the present invention.

FIG. 1 illustrates an exemplary floor plan of a single floor of a multi-story building B utilizing the passenger and vehicle elevator system 10. In the exemplary floor plan of FIG. 1, three separate elevators 12, 14, 16 are shown positioned about a central axis A of the building B. It will be understood that each elevator 12, 14, 16 includes an elevator car that may be selectively raised or lowered within a cylindrical elevator shaft by conventional elevator machinery, which is not shown in the drawings for clarity. It should be understood that the cylindrical elevator shaft is shown for exemplary purposes only, and that the contouring and relative dimensions of both the elevator shaft and corresponding elevator car may be varied as desired. Each elevator car includes at least one inner set of doors (or a single door) that selectively open and close, and each floor of the multi-story building includes at least one set of outer doors (or a single door), and preferably two angularly offset sets of outer doors, corresponding to each elevator 12, 14, and 16. It should be understood that any desired number of elevators may be utilized, and that their positioning with respect to a building floor may be varied. In the exemplary configuration of FIG. 1, in which the three elevators 12, 14, 16 are positioned such that their centers are equidistant from axis A, the elevators 12, 14, 16 are arrayed as an equilateral triangle, with each of elevators 12, 14, 16 serving one of regions 18, 20, 22. For the circular arrangement of the floor plan shown in the example of FIG. 1, each of regions 18, 20, 22 spans approximately 120° of arc, and each region 18, 20, 22 is separated from the adjacent region(s) by exemplary stairwells S or the like.

In the exemplary configuration of FIG. 1, each of regions 18, 20, 22 is bisected (as indicated by the dashed, radial lines in FIG. 1), such that region 18 is divided into sub-regions 24, 26; region 20 is divided into sub-regions 28, 30; and region 22 is divided into sub-regions 24-34. Each of the sub-regions 24-34 represents an individual office or dwelling space. Thus, in this exemplary layout, each of the three regions 18, 20, 22 contains two individual offices or dwelling spaces. As shown, there are two parking spaces allocated for each sub-region 24-34. Sub-region 24 includes a pair of parking spaces 36; sub-region 26 includes a pair of parking spaces 38; sub-region 28 includes a pair of parking spaces 40; sub-region 30 includes a pair of parking spaces 42; sub-region 32 includes a pair of parking spaces 44; and sub-region 34 includes a pair of parking spaces 46. The living quarters or office space for each sub-region may be disposed radially outward from the corresponding parking spaces for the sub-region.

Figure 2A:
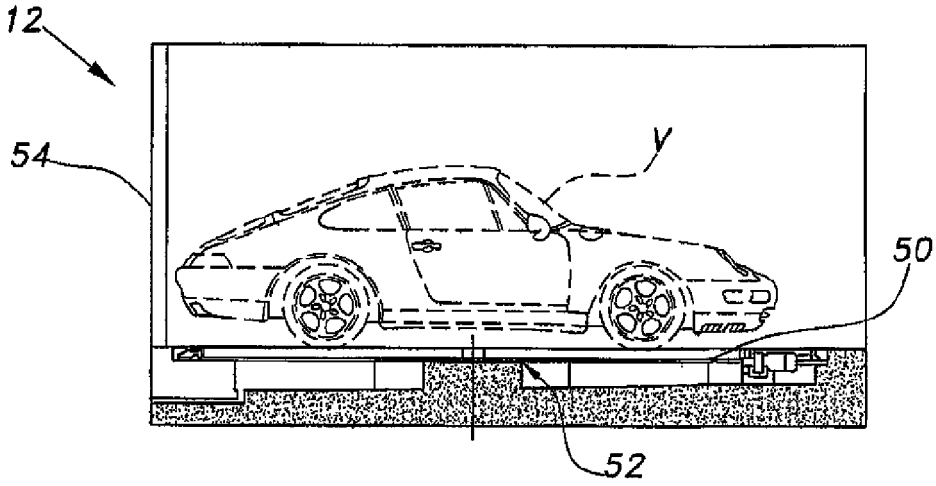
FIG. 2A is a diagrammatic side view in section of an individual elevator car of the passenger and vehicle elevator system according to the present invention.
Figure 2B:
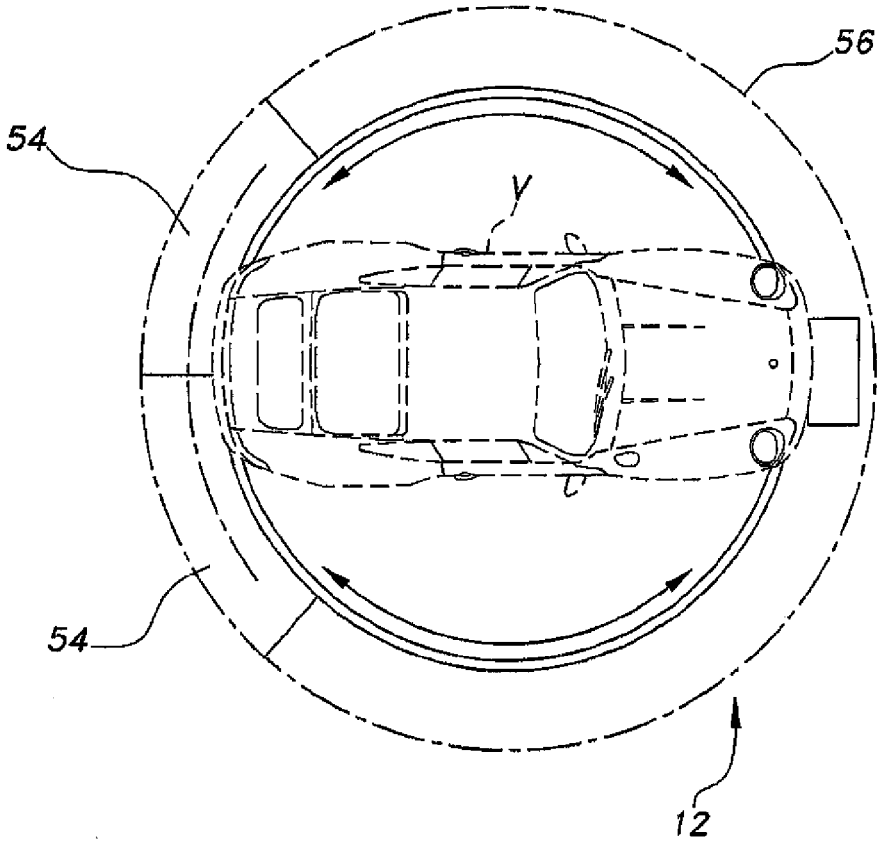
FIG. 2B is a diagrammatic top view of the individual elevator car of FIG. 2A.

Each of elevators 12, 14 and 16 operates in an identical manner. In FIGS. 2A and 2B, a single elevator car 12 is illustrated. In order for the elevator car 12 to provide access to any of the two parking space pairs 36, 38 in sector 18 (in the configuration of FIG. 1), either the inner doors 54 of the elevator car of elevator 12 may comprise one set spanning 180° of the elevator car and the elevator 12 may be equipped with a turntable to select either sub-region 24 to access parking spaces 36 or sub-region 26 to access parking spaces 38, or the inner doors 54 of the elevator car may comprise two side-by-side sets which each span 90° and the floor of the elevator car may rotate to select either sub-region 24 or sub-region 26. Preferably sub-region 24 has one set of outer doors 56 that open when sub-region 24 is selected, and sub-region 26 has another set of outer doors 56 that open when sub-region 26 is selected. In the exemplary circular configuration of the elevators illustrated in FIGS. 1 and 2B, the inner doors 54 and the outer doors 56 must open and close along an arcuate or circumferential path, rather than the conventional rectilinear path of conventional elevator doors.

As shown in FIG. 2A, the vehicle V is positioned on a platform 50 within the elevator 12, and the platform 50 is mounted on a controllable, rotational mount 52. This rotational mount drives rotation of the platform 50. This rotation not only allows selection of any of the four parking spaces within a particular region, but further allows the vehicle V to enter the elevator 12 front end first and then be rotated within the elevator to also exit the elevator 12 front end first. Such rotating platforms and drive systems are well known, and any suitable type of controllable, rotational mount 52 may be utilized. One such rotating platform is manufactured by PALIS Global Parking Technologies GmbH of Gersthofen, Germany. Another such mount is the Turntable 505, manufactured by Otto Wöhr GmbH of Fiolzheim, Germany. Other examples of such rotating platforms for vehicles are shown in U.S. Pat. No. 4,264,257, issued to Saurwein, and U.S. Patent Application Publication No. US 2005/0095092 A1, to Segal et al, each of which is hereby incorporated by reference in its entirety.

Figure 3A:
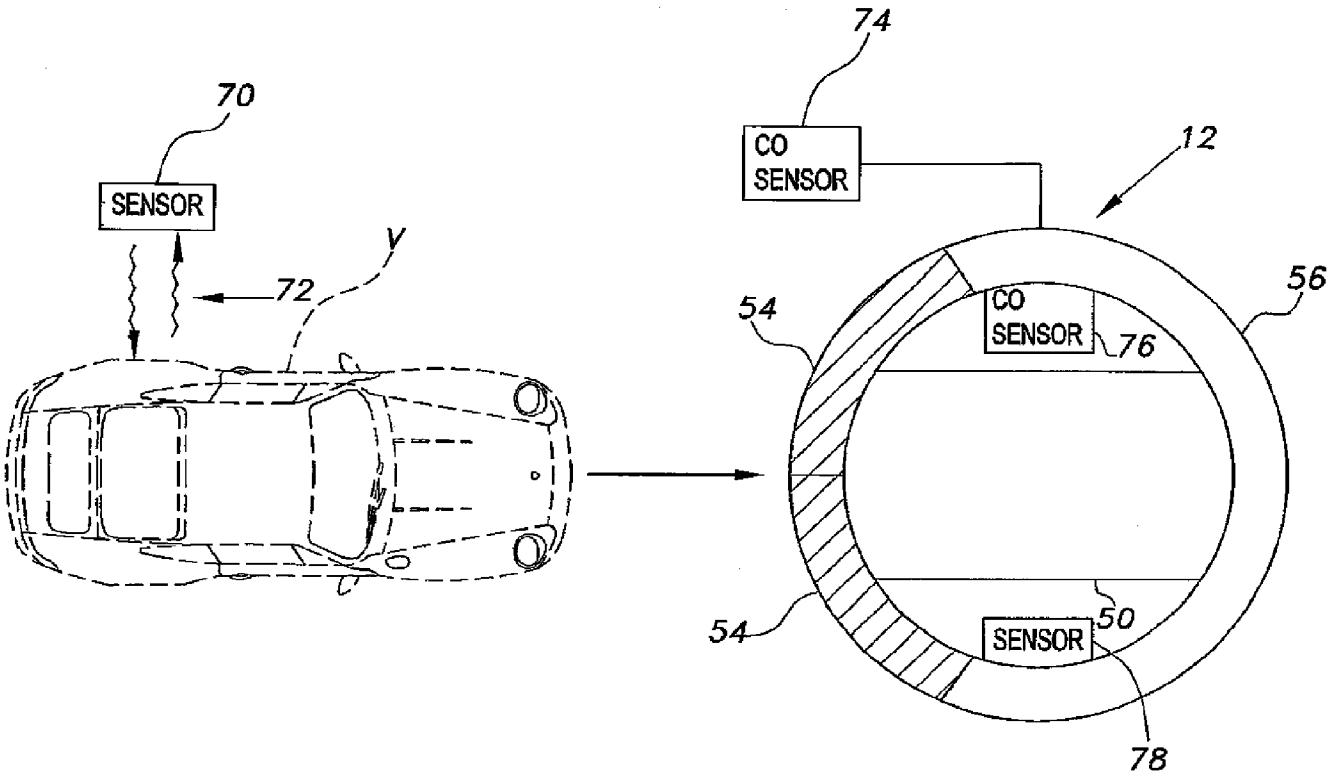
FIG. 3A is a diagrammatic environmental top view, partially in section, illustrating a vehicle approaching an individual elevator of the passenger and vehicle elevator system according to the present invention.
Figure 3B:
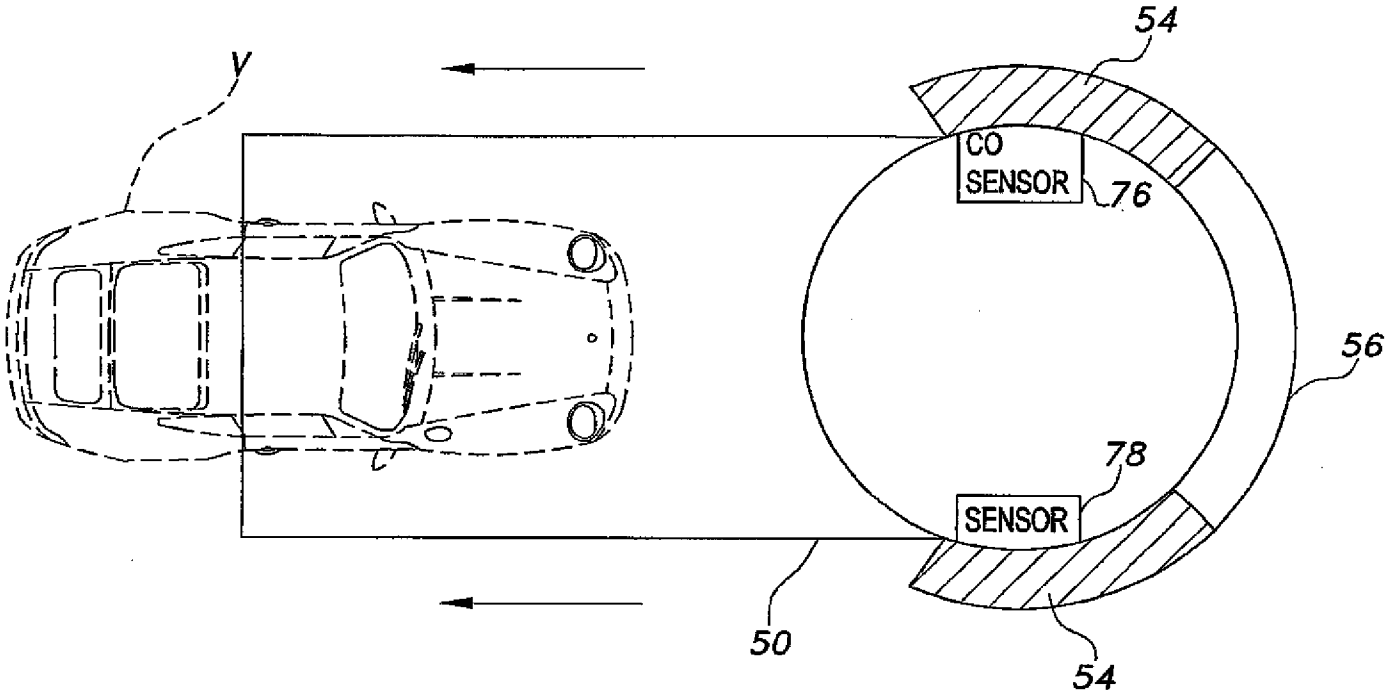
FIG. 3B is a diagrammatic environmental top view, partially in section, illustrating extension of a platform of the elevator of FIG. 3A to carry the vehicle into the elevator.
Figure 3C:
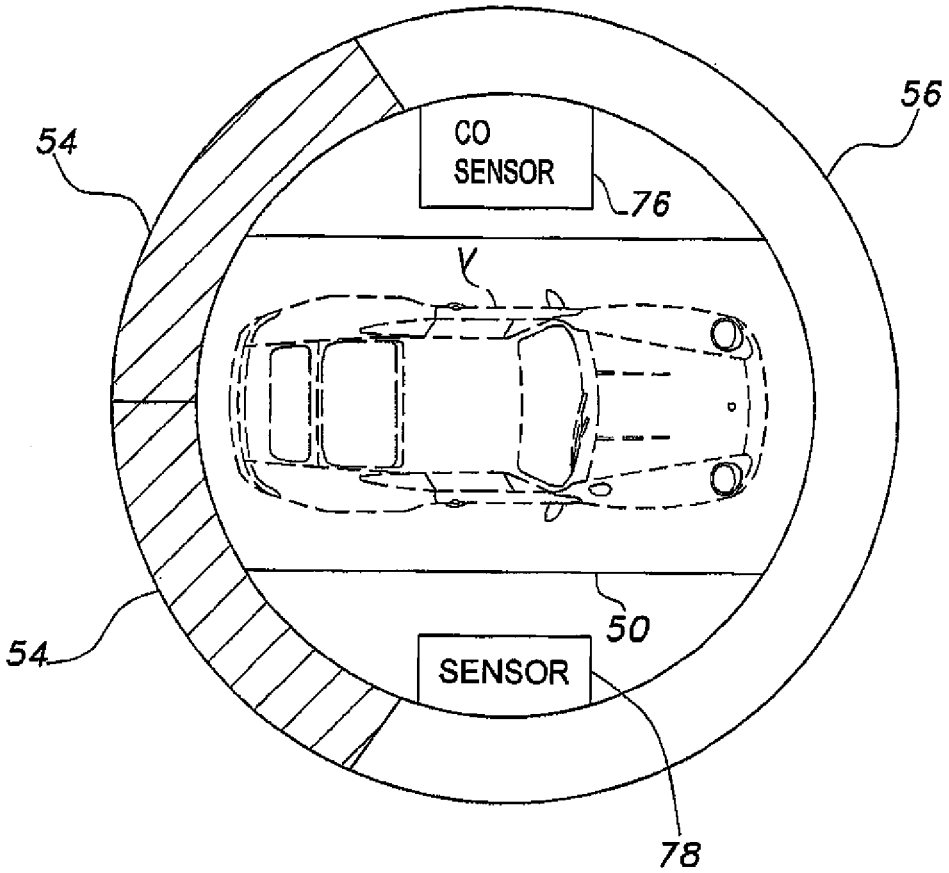
FIG. 3C is a diagrammatic environmental top view, partially in section, illustrating the vehicle carried within the elevator of FIG. 3A.

In addition to the rotation of the platform 50 by rotational mount 52, the platform 50 is also preferably horizontally translatable. FIG. 3A illustrates a vehicle V first approaching the doors 54 of the elevator 12. In FIG. 3B, the doors 54 have circumferentially opened, as described above, and the platform 50 is linearly translated beneath the vehicle V and raised to carry the vehicle V. Once the platform 50 is fully positioned under the vehicle V and raised to support the vehicle, the platform 50 is translated back into the elevator 12, as shown in FIG. 3C, and the vehicle V may be carried to the desired floor.

It should be understood that any suitable type of driven platform may be utilized. Such translational dollies and mounts are well known. One such driven platform is manufactured by PALIS Global Parking Technologies GmbH of Gersthofen, Germany. Other examples of other such systems are shown in PCT Application Publication No. WO 2004/045932 A1, to Zangerle et al., and U.S. Pat. No. 4,768,914, issued to Sing, each of which is hereby incorporated by reference in its entirety.

It should be understood that the system 10 may be used in combination with any suitable type of multi-story building. In use, vehicle V enters a ground floor, below-ground floor or lobby level and drives to one of elevators 12, 14, 16, positioning the vehicle as shown in FIG. 3A. Preferably, at the entrance, the vehicle passes by a sensor 70, as shown in FIG. 3A. Sensor 70 may be a bar code reader, an RFID sensor or the like, exchanging signals 72 with a matching label or device mounted on vehicle V for identifying the vehicle, including data identifying the vehicle's assigned floor and parking space. In response to the identification of the particular vehicle V and its assigned floor and parking space, the vehicle V is directed towards the appropriate entry or staging area in front of the corresponding one of elevators 12, 14, 16 for the particular parking space.

Once at the appropriate staging area, the driver turns off the ignition of vehicle V and preferably remains within the vehicle V. The doors 54 to the elevator associated with the particular staging area open and the automatically controlled translating platform or dolly 50 moves outward from the elevator. The platform 50 moves underneath the vehicle V, lifts the vehicle V, and withdraws back into the elevator with the vehicle V remaining on the platform 50. The elevator doors 54 then close and the elevator ascends to the appropriate floor or level.

Once at the appropriate floor or level, the elevator doors 54 open and the laterally moving platform extends outward and deposits the vehicle V in its assigned parking space. The laterally moveable platform then withdraws from under the vehicle V, moves back into the elevator, the elevator doors 54 close, and the elevator is then ready to move the next vehicle. When the driver of vehicle V wishes the leave the building B, the driver signals for the appropriate elevator and the process is reversed.

As noted above, since at least two parking spaces are preferably associated with each office or residential unit, the system 10 not only raises the vehicle V from the entrance level to the appropriate floor of the building B, but is also capable of moving the vehicle V to the correct parking space. This is accomplished by the rotating mount 52 for rotating the platform 50. As an alternative, the platform 50 may be equipped with its own turntable, rather than being mounted thereon. During the ascent from the entrance level, the platform 50 may be rotated, if necessary, such that the vehicle V is placed into the correct parking space. During the descent back to the street level, the platform 50 is rotated so that when the elevator doors 54 open, the platform 50 moves the vehicle V outwardly into the departure area. Preferably, the departure area is spaced apart from the staging or loading area such that vehicles may egress from the building without interfering with the progression of other vehicles which are entering the building and waiting in the staging area. It should be understood that though two exemplary parking spaces are shown for each office or residential unit, any desired number of parking spaces may be allotted.

Since the vehicle V is being transported vertically with one or more passengers within the elevator, and since the vehicles are being parked within the building at a level coextensive with an office or a residence, it is desirable to avoid having the vehicle engine operating either in the elevator or in the parking area. Thus, once the vehicle V initially enters the loading or staging area, a carbon monoxide detector 74 will register if the vehicle engine is operating and a positive response from the carbon monoxide detector 74 will prevent loading the vehicle onto the elevator. For example, doors 54 may remain closed until a zero or minimal level of carbon monoxide is measured by sensor 74. Should the vehicle engine be off upon the entry into the elevator, but the engine started thereafter, one or more carbon monoxide sensors 76 within the elevator will stop the elevator's ascent and return the elevator to the entrance level. It should be understood that any suitable type of sensors may be utilized to ensure that the vehicle is not in operation. Additional sensors may be used to measuring vehicle dimensions, motion or the like, such as laser sensors, for example.

In order to avoid injury to the operator of the vehicle and/or any passengers, suitable motion detectors or optical sensors 78 may further be provided within the elevator to detect opening of the vehicle door or trunk, which may be utilized as a basis for stopping the ascent or descent of the elevator. Further, conventional smoke, heat or fire detectors may also be mounted within the elevator.

Although the elevators 12, 14, 16 may be varied in number, size and overall configuration, each elevator should be of a size sufficient to accommodate, for example, a vehicle of approximately six meters in length and two meters in width. Similarly, each elevator should be able to accommodate the weight of a motor vehicle and its passengers, preferably being able to carry loads up to approximately 3,500 kg.

It is to be understood that the present invention is not limited to the embodiments described above, but encompasses any and all embodiments within the scope of the following claims.

I claim:

1. A passenger and vehicle elevator system, comprising:

an elevator car having a housing and at least one door, the housing having a floor, a ceiling and at least one sidewall, the housing being adapted for carrying a vehicle and at least one passenger;

a linearly translating platform mounted on the floor of the housing, the linearly translating platform being adapted for carrying the vehicle and the at least one passenger through the at least one door;

a first carbon monoxide sensor mounted external to the housing;

means for preventing the vehicle from entering the housing when the first carbon monoxide sensor detects levels of carbon monoxide indicating an engine of the vehicle is operating;

means for selectively rotating the vehicle within the housing; and means for selectively raising and lowering the elevator car.

2. The passenger and vehicle elevator system as recited in claim 1, wherein the housing is substantially cylindrical.

3. The passenger and vehicle elevator system as recited in claim 2, wherein the at least one door is arcuate.

4. The passenger and vehicle elevator system as recited in claim 1, further comprising at least one sensor configured for reading parking information from the vehicle.

5. The passenger and vehicle elevator system as recited in claim 4, wherein the at least one sensor comprises an RFID reader.

6. The passenger and vehicle elevator system as recited in claim 4, wherein the at least one sensor comprises a bar code reader.

7. The passenger and vehicle elevator system as recited in claim 1, further comprising:

a second carbon monoxide sensor mounted within the housing; and means for preventing the elevator car from parking the vehicle within the building when the second carbon monoxide sensor detects levels of carbon monoxide indicating the engine of the vehicle is operating.

8. The passenger and vehicle elevator system as recited in claim 7, further comprising:

a motion sensor mounted within the housing; and means for preventing the elevator car from parking the vehicle within the building when the motion sensor detects motion within the housing.

9. A passenger and vehicle elevator system, comprising:

an elevator car configured for being raised and lowered, the elevator car having an opening and at least one door for closing the opening, the elevator car having a floor, a ceiling and at least one sidewall, the elevator car being configured for carrying a vehicle and at least one passenger;

a linearly translating platform being displaceable into and out of the elevator car, the linearly translating platform being configured for carrying the vehicle and the at least one passenger through the opening; and a carbon monoxide sensor disposed external to the elevator car, the carbon monoxide sensor for preventing the vehicle from entering the elevator car when the carbon monoxide sensor detects levels of carbon monoxide indicating an engine of the vehicle is operating.

10. A method of parking a motor vehicle comprising:

providing the passenger and vehicle elevator system according to claim 9;

determining if an engine of the motor vehicle is operating with the carbon monoxide sensor;

loading the vehicle into the elevator car with the platform when it is determined by the carbon monoxide sensor that the engine of the motor vehicle is not operating; and denying loading of the motor vehicle into the elevator car when it is determined by the carbon monoxide sensor that the engine of the motor vehicle is operating.

11. A passenger and vehicle elevator system, comprising:

an elevator car configured for being raised and lowered, the elevator car having an opening and at least one door for closing the opening, the elevator car having a floor, a ceiling and at least one sidewall, the elevator car being configured for carrying a vehicle and at least one passenger;

a linearly translating platform being displaceable into and out of the elevator ear, the linearly translating platform being configured for carrying the vehicle and the at least one passenger through the opening; and a carbon monoxide sensor mounted within the elevator car, the carbon monoxide sensor preventing the vehicle from being parked within the building when the carbon monoxide sensor detects levels of carbon monoxide indicating the engine of the vehicle is operating.

12. A method of parking a motor vehicle comprising:

providing the passenger and vehicle elevator system according to claim 11;

determining if an engine of the motor vehicle is operating when in the elevator car;

returning the vehicle to a base with the elevator car and unloading the motor vehicle with the platform if it is determined that the engine of the motor vehicle is operating or becomes operational while in the elevator car;

delivering the motor vehicle to an assigned parking space when the engine of the motor vehicle is in a non-operational state; and parking the motor vehicle in the assigned parking space when the engine of the motor vehicle maintains the non-operational state.

13. A multi-story building comprising:

individual dwellings and/or offices, each having a respective parking space;

the passenger and vehicle elevator system of claim 9 for delivering the motor vehicle to the respective parking spaces.

14. A multi-story building comprising:

individual dwellings and/or offices, each having a respective parking space;

the passenger and vehicle elevator system of claim 11 for delivering the motor vehicle to the respective parking spaces.

* * * * *